US007030758B1

(12) United States Patent
Markegard et al.

(10) Patent No.: US 7,030,758 B1
(45) Date of Patent: Apr. 18, 2006

(54) DOOR BLOCKING BRACE AND LOCK

(75) Inventors: Harvey K. Markegard, Billings, MT (US); Joseph M. Higgins, Billings, MT (US)

(73) Assignee: Blockit & Lockit Systems, Billings, MT (US)

( * ) Notice: Subject to any disclaimer, the term of this patent is extended or adjusted under 35 U.S.C. 154(b) by 133 days.

(21) Appl. No.: 10/848,304

(22) Filed: May 18, 2004

(51) Int. Cl.
*G08B 13/08* (2006.01)

(52) U.S. Cl. ..... 340/546; 340/545.1; 340/566; 292/338; 292/339

(58) Field of Classification Search ..... 340/546, 340/545.1, 566, 693.5; 292/338, 339, 269; 200/61.49

See application file for complete search history.

(56) References Cited

U.S. PATENT DOCUMENTS

| | | | | |
|---|---|---|---|---|
| 4,036,518 | A * | 7/1977 | Jost | 292/339 |
| 4,358,758 | A | 11/1982 | Morton | |
| 4,442,427 | A | 4/1984 | Morton | |
| 4,607,253 | A | 8/1986 | Wooton et al. | |
| 4,819,296 | A * | 4/1989 | Wilkins | 16/82 |
| 5,131,701 | A | 7/1992 | Stepniewski | |
| 5,333,922 | A | 8/1994 | Jones | |
| 5,340,175 | A | 8/1994 | Wood | |
| 5,392,026 | A | 2/1995 | Marik | |
| 5,787,548 | A | 8/1998 | Tzen | |
| D431,997 | S | 10/2000 | Markegard et al. | |

* cited by examiner

*Primary Examiner*—Anh V. La
(74) *Attorney, Agent, or Firm*—Margaret Polson; Patent Law Offices of Rick Martin, PC

(57) ABSTRACT

The present invention relates to a folding door brace to prevent unwanted entry of an intruder. The present invention is a folding, portable door brace that may be easily installed and removed on a wide variety of door types. The door brace also has a motion sensor and an alarm to alert any occupants of the room to any attempts to open the door. A number of interchangeable foot pads are provided to allow the door brace to be used with a variety of different floor surfaces.

3 Claims, 12 Drawing Sheets

DOOR BLOCKING BRACE AND LOCK

FIELD OF INVENTION

The present invention relates to a door blocking brace which houses a state-of-the-art battery operated motion detector having audio and visual alarms.

BACKGROUND OF THE INVENTION

Home intrusions are one of the most frightening crimes that can occur to a person. The sense of violation of personal space and the terror of knowing that a stranger was in one's living space makes this type of crime far more upsetting than the simple loss of property caused by many other crimes. In addition, many "home" intrusions occur in hotel rooms, dorm rooms and other temporary living spaces where the occupant does not have control of the type of locks and other security devices.

Below follows a summary of related art.

U.S. Pat. No. 4,358,758 (1982) to Morton discloses a door jam that extends as well as an electric switch which senses a closure of the jam tube, thereby activating an electronic alarm. The device does not have a cam extension tube, but rather a crude multi-hole and clip length adjustment.

U.S. Pat. No. 4,442,427 (1984) to Morton adds a smoke alarm to his '758 patent.

U.S. Pat. No. 4,607,253 (1986) to Wooten et al. discloses a door jam with pads at each end and a switch to sense a movement of the shaft.

U.S. Pat. No. 5,131,701 (1992) to Stepniewski discloses a door jam having a cam actuated extension tube to create a wedge effect against the door.

U.S. Pat. No. 5,333,922 (1994) to Jones discloses a segmented door jam with a non-skid pad on the foot.

U.S. Pat. No. 5,340,175 (1994) to Wood discloses a door jam with a switch to sense an attempted door opening, an interchangeable carpet/hard floor foot and a length adjuster.

U.S. Pat. No. 5,392,026 (1995) to Marik discloses a door jam with a motion detector.

U.S. Pat. No. 5,787,548 (1998) to Tzen discloses a door jam with a cam/handle activated extension tube.

The above inventions have several limitations. Most are not easy for the user to transport from one location to another, making them unsuitable for use by travelers. Jones '922 discloses a segmented door jam that can be taken apart and folded into a portable form. However, the segments of Jones are not attached together in any way when they are taken apart, so it is possible for segments to get lost or left behind, rendering the device useless. In addition, it takes time for the user to assemble and disassemble the device. Most of the above inventions also only have one footpad surface to rest on the floor, making them difficult or impossible to use on a variety of surfaces.

Most of the above do not have a motion sensor. Those that do have a motion sensor have the motion sensor on the shaft of the device, instead of at the yoke, reducing the potential sensitivity of the motion sensor. Since part of the purpose of an audible alarm is to scare away a potential intruder, it is advantageous to have the potential to detect someone trying the doorknob and/or trying to pick the lock. In addition, most of the present inventions do not have any type of visual alarm, making it less useful for hearing impaired users.

SUMMARY OF THE INVENTION

The primary aspect of the present invention is to provide a multi-layer security system to prevent a door being opened, including a first mechanical layer to physically block the door from being opened, a second electronic motion detector siren level, and a third motion detector strobe light level.

Other aspects of this invention will appear from the following description and appended claims, reference being made to the accompanying drawings forming a part of this specification wherein like reference characters designate corresponding parts in the several views.

The present invention provides:

Layered Protection:

Mechanical Protection

Electronic Protection

Audio Protection

Mechanical Protection:

Changeable footpad allows use on many surfaces.

Easily installed.

Easily removed.

Easily folded for traveling.

Locks in place without use of key.

Electronic Protection:

A single switch activates L.E.D. visual warning system, a siren, and a strobe light, and sets a motion detector.

When the motion detector's tamper tolerance is exceeded, a strobe light flashes at pre-calculated intervals for a specified amount of time and a siren sounds.

After reaching its specified amount of time, the strobe light and siren reset.

Continued tampering will repeat sequence.

Audio Protection:

A loud siren is provided both to scare away intruder and to warn the occupant of the room of any tampering with the door.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
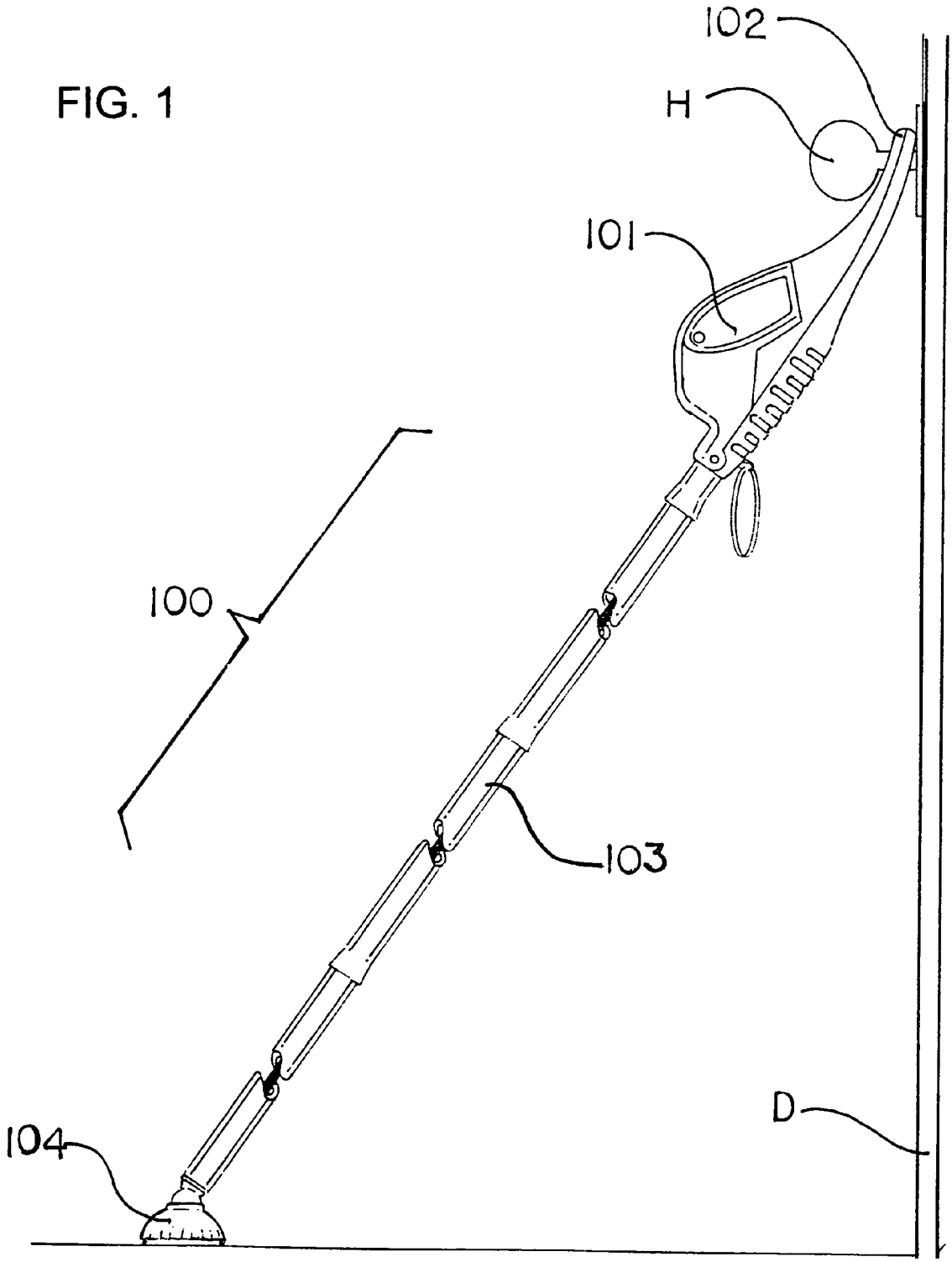
FIG. 1 is a side perspective view of the preferred embodiment in the deployed position on a door.

Referring first to FIG. 1, the present invention 100 is shown installed against a door D. The handle 101 has a yoke 102 which fits around door knob H. The shaft 103 extends from the handle 101 to the pivoting foot 104, bracing the door D in a known manner.

Figure 2:
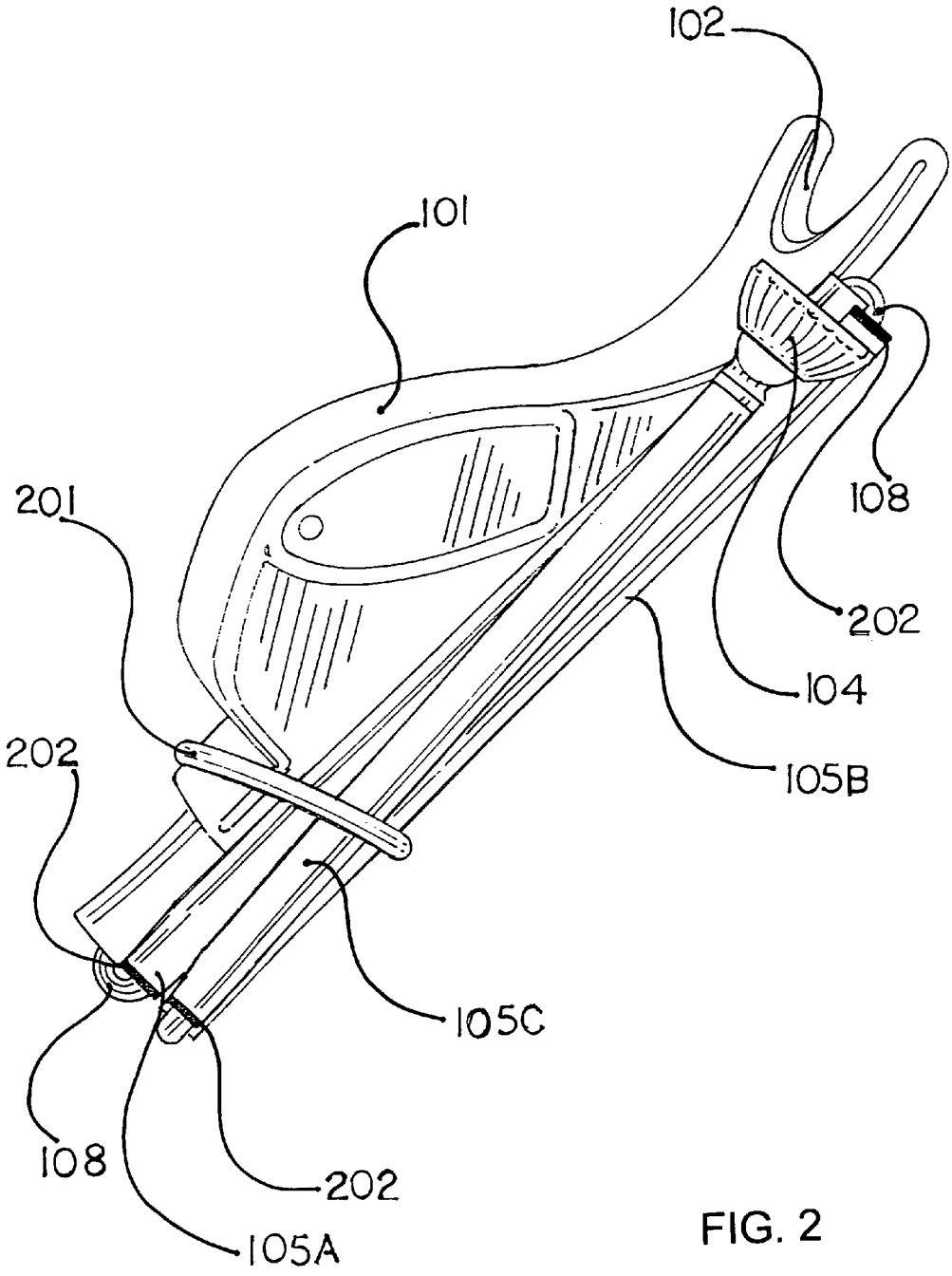
FIG. 2 is a side perspective view of the preferred embodiment in the folded position.
Figure 4:
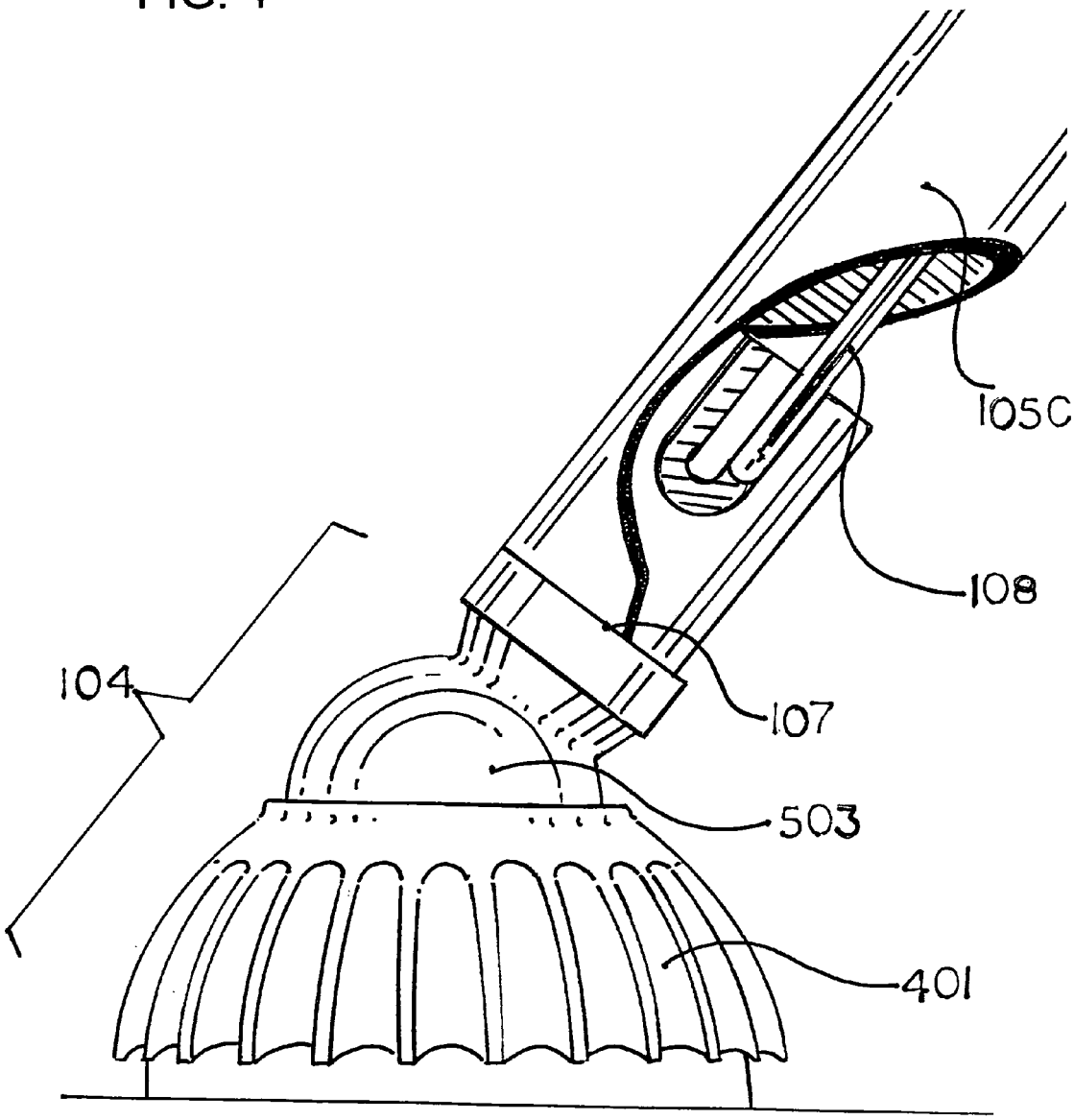
FIG. 4 is cutaway view of the attachment of the pivoting foot to the shaft.
Figure 5:
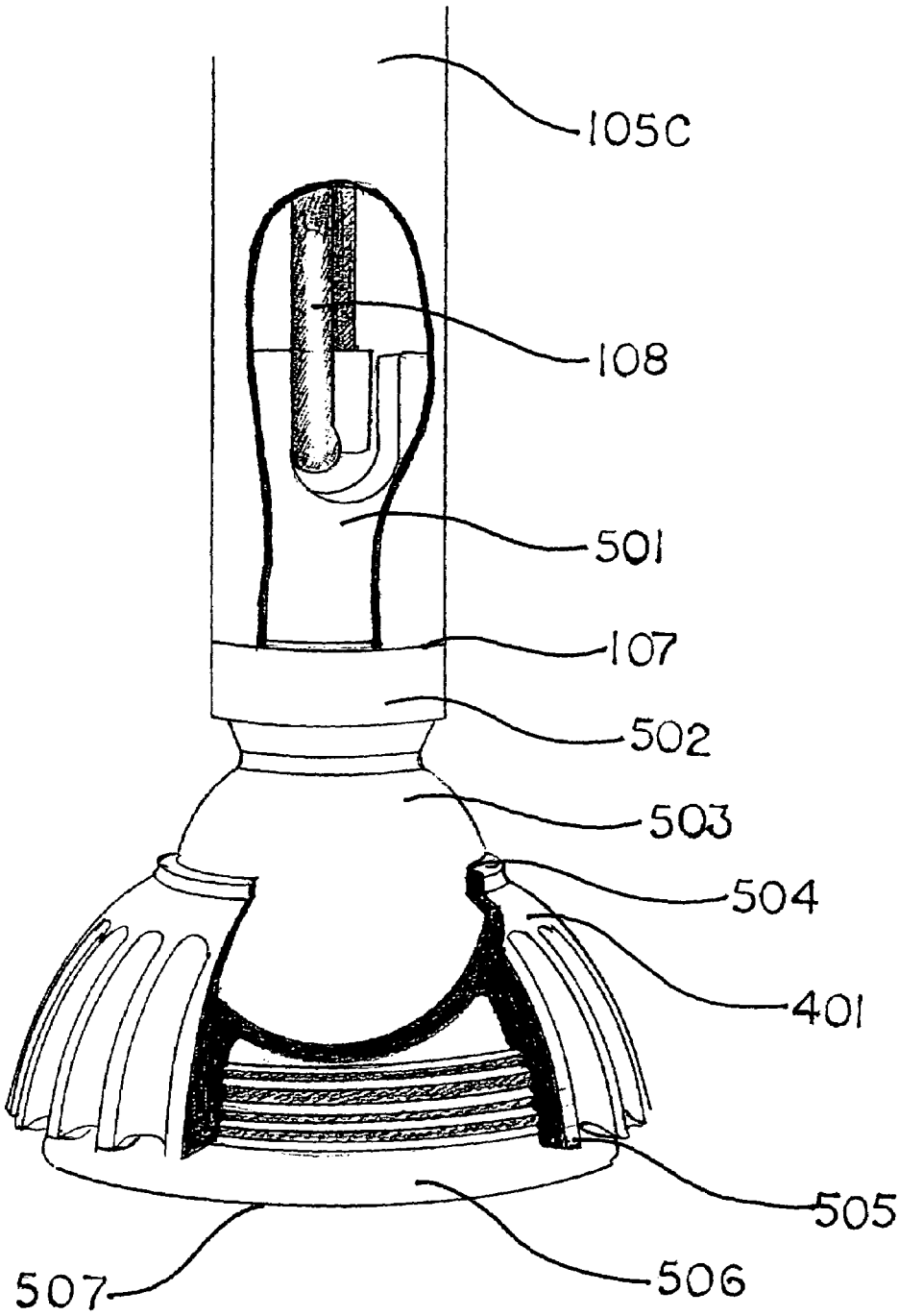
FIG. 5 is cutaway view of the pivoting foot showing the removable footpad.

As shown in FIG. 2, the shaft 103 is made up of hollow segments 105*a*, 105*b*, and 105*c* which can be pulled apart. The top end 106 of each shaft 105 is tapered to fit into the bottom end 107 of the next segment. An elastic cord 108 is attached inside the handle 101 and at the top 501 the pivoting foot 104, as shown in FIGS. 4 and 5. The cord 108 runs through all of the segments 105 attaching the segments 105 together. Each segment can have an end cap 202 to reduce the rubbing on the elastic cord 108.

When the user wishes to transport the door brace 100 s/he simply pulls apart the segments 105*a*, 105*b*, and 105*c* and folds them next to each other. Although the disclosed embodiment has three segments, two, four, five or more segments are also possible. The number of segments will be determined by the overall size desired of the folded mode. Travel strap 201 is provided on the handle 101 to hold the segments 105 folded as shown in FIG. 2.

As shown in FIGS. 4 and 5, the disclosed embodiment of pivoting foot 104 has a ball and socket type joint. The base 401 functions as the socket. As shown in FIG. 5, the bottom end 107 of bottom segment 105*c* has an end cap 502 with a ball 503. The ball 503 fits inside the top opening 504 base 401 and pivots freely within the base 401. The ball and socket joint allows the pivoting foot 104 to adjust to uneven floor surfaces and still securely hold the door brace 100 in place in use.

The bottom end 505 of the base 401 is threaded to receive a footpad 506. The footpad 506 is threaded to allow the easy interchange of different types of footpads. Other known methods of removably attaching the footpad 506 would also work well. It is important that the footpad 506 be securely attached to the base 401, so that the footpad 506 does not come off in user. The bottom surface 507 of the footpad 506 rests against the floor in front of the door D. Different floor surfaces require different bottom surfaces to hold the door brace 100 securely in place. There are multiple different types of common floor surfaces, including carpet, tile, stone, wood, or cement. Four different footpads are shown in FIGS. 6–9.

Figure 6:
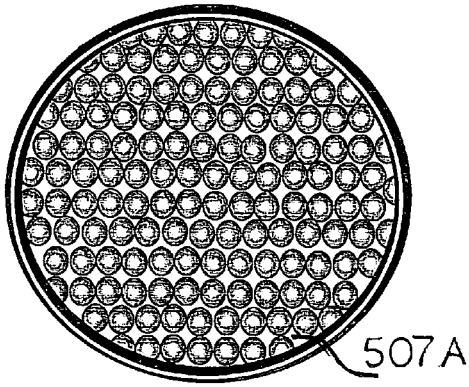
FIG. 6 is a bottom plan view of the carpeted surfaces version of the footpad.
Figure 7:
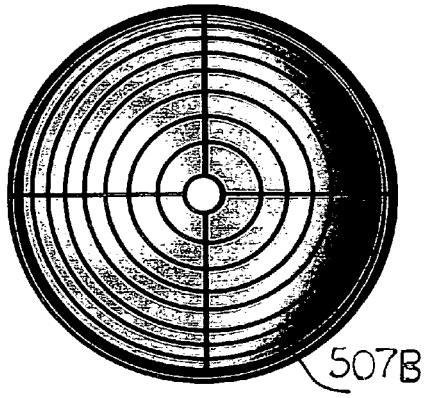
FIG. 7 is a bottom plan view of the hard and smooth surfaces version of the footpad.
Figure 8:
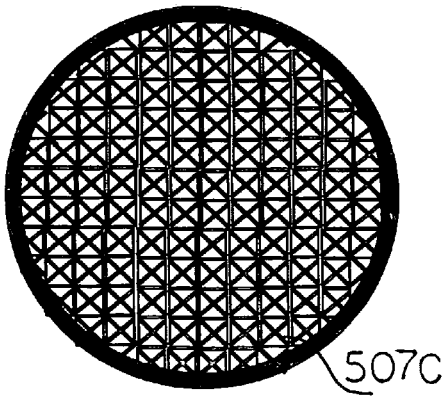
FIG. 8 is a bottom plan view of the industrial floors version of the footpad.
Figure 9:
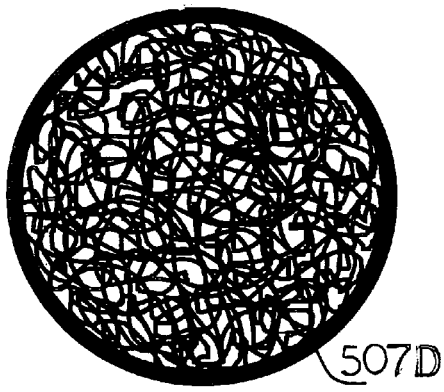
FIG. 9 is a bottom plan view of the uneven hard surfaces version of the footpad.

FIG. 6 shows the bottom surface 507*a* for carpeted surfaces. FIG. 7 shows the bottom surface 507*b* for hard smooth floors, like hard wood floors or linoleum. FIG. 8 shows the bottom surface 507*c* for industrial floors. FIG. 9 shows the bottom surface 507*d* for uneven hard surfaces.

When the user wishes to switch the door brace from one location to another, the desired footpad 506 is simply threaded into the base 401.

Figure 10:
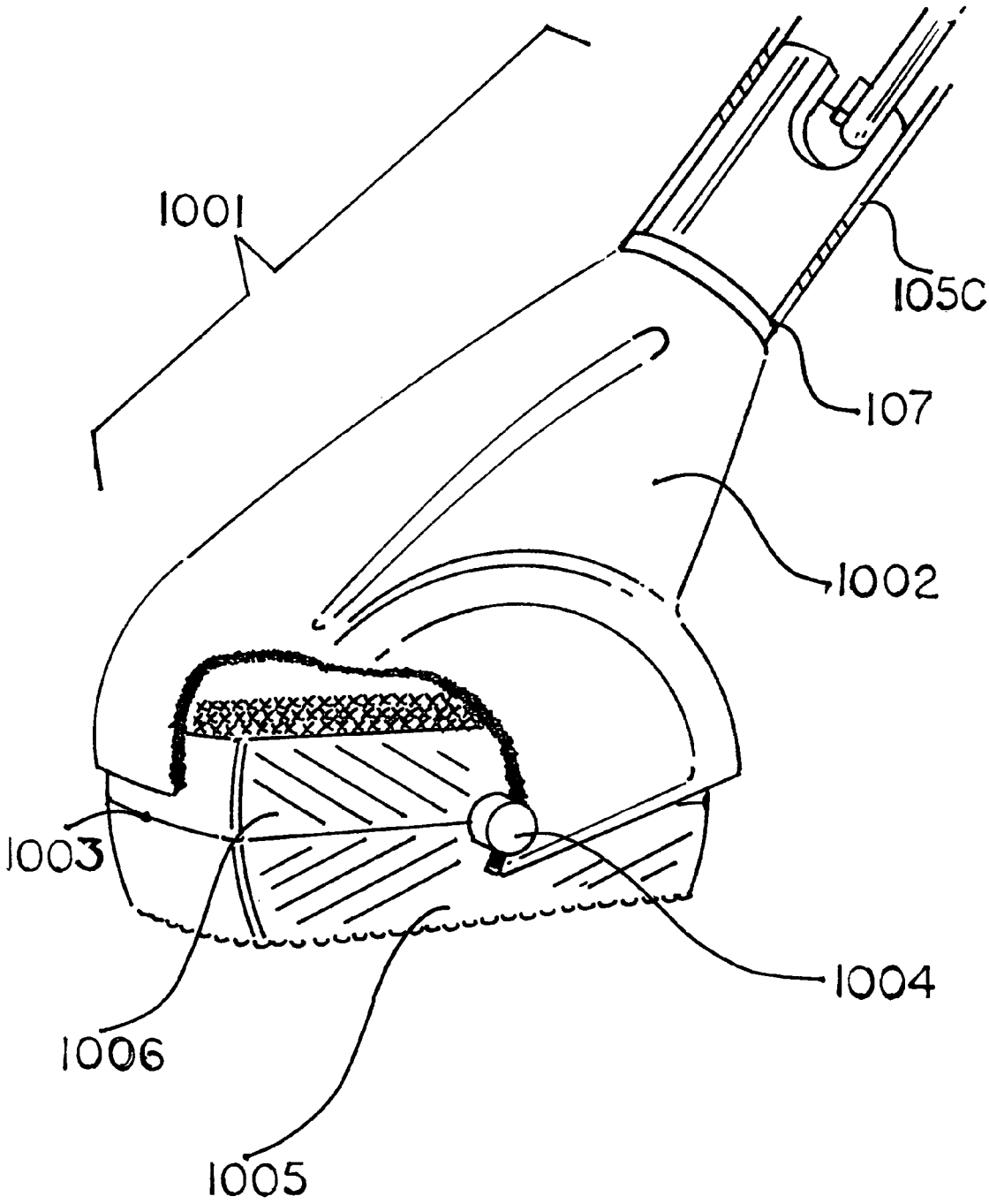
FIG. 10 is a cutaway view of an alternate pivoting foot assembly.

An alternate embodiment of the pivoting foot 1001 is shown is FIG. 10. In the alternate embodiment the bottom end 107 has a cap 1002 which fits over base 1003 and is pivotally attached at pivot 1004. The floor pad 1005 is rotatably attached to the upper base 1006, allowing the user to flip between two possible pads. In the pictured embodiment a sponge like pad 1005 is on one side and a comb like pad 1006 is on the other.

Figure 11:
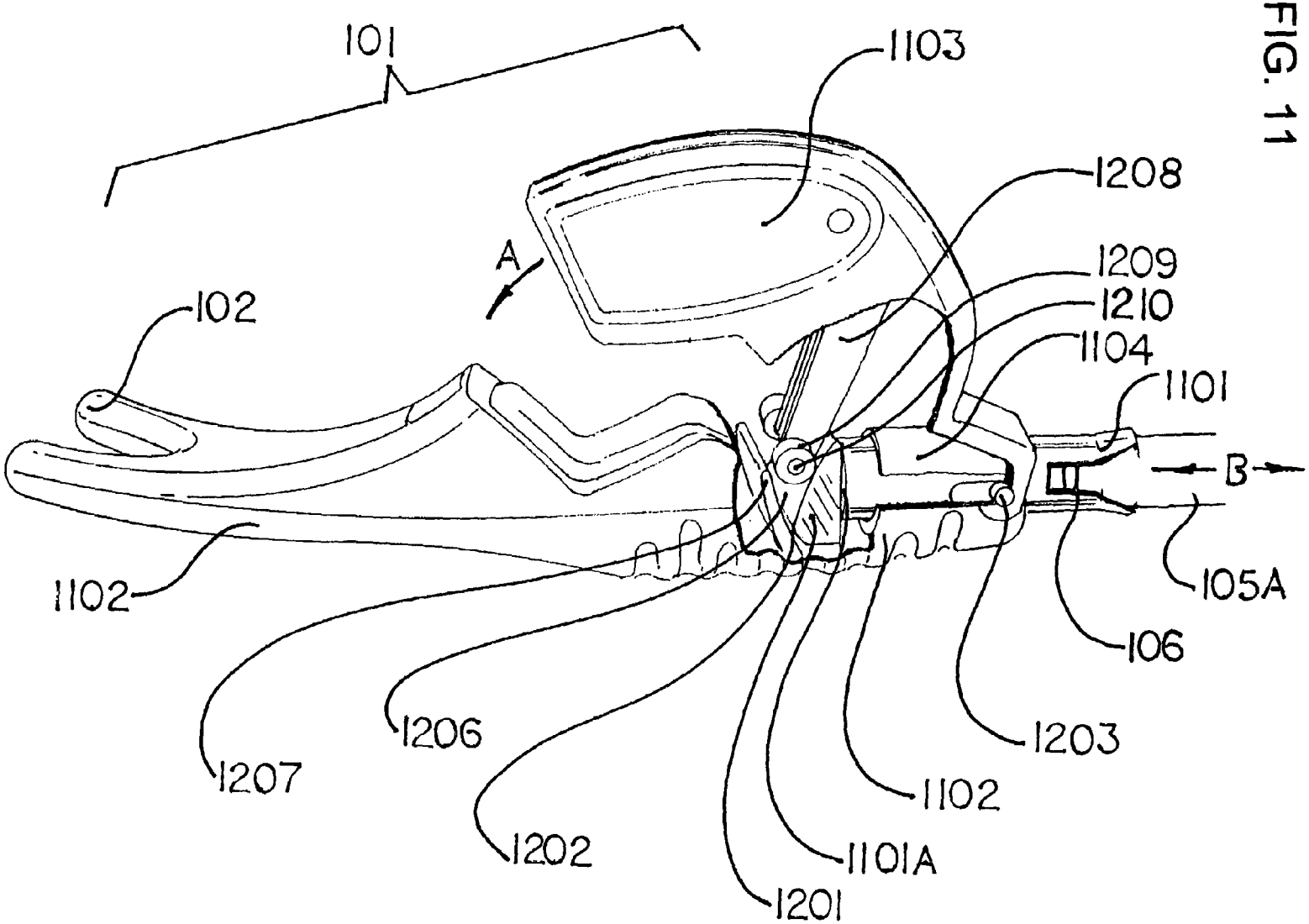
FIG. 11 is a partially cutaway view of the head assembly in the open position.
Figure 12:
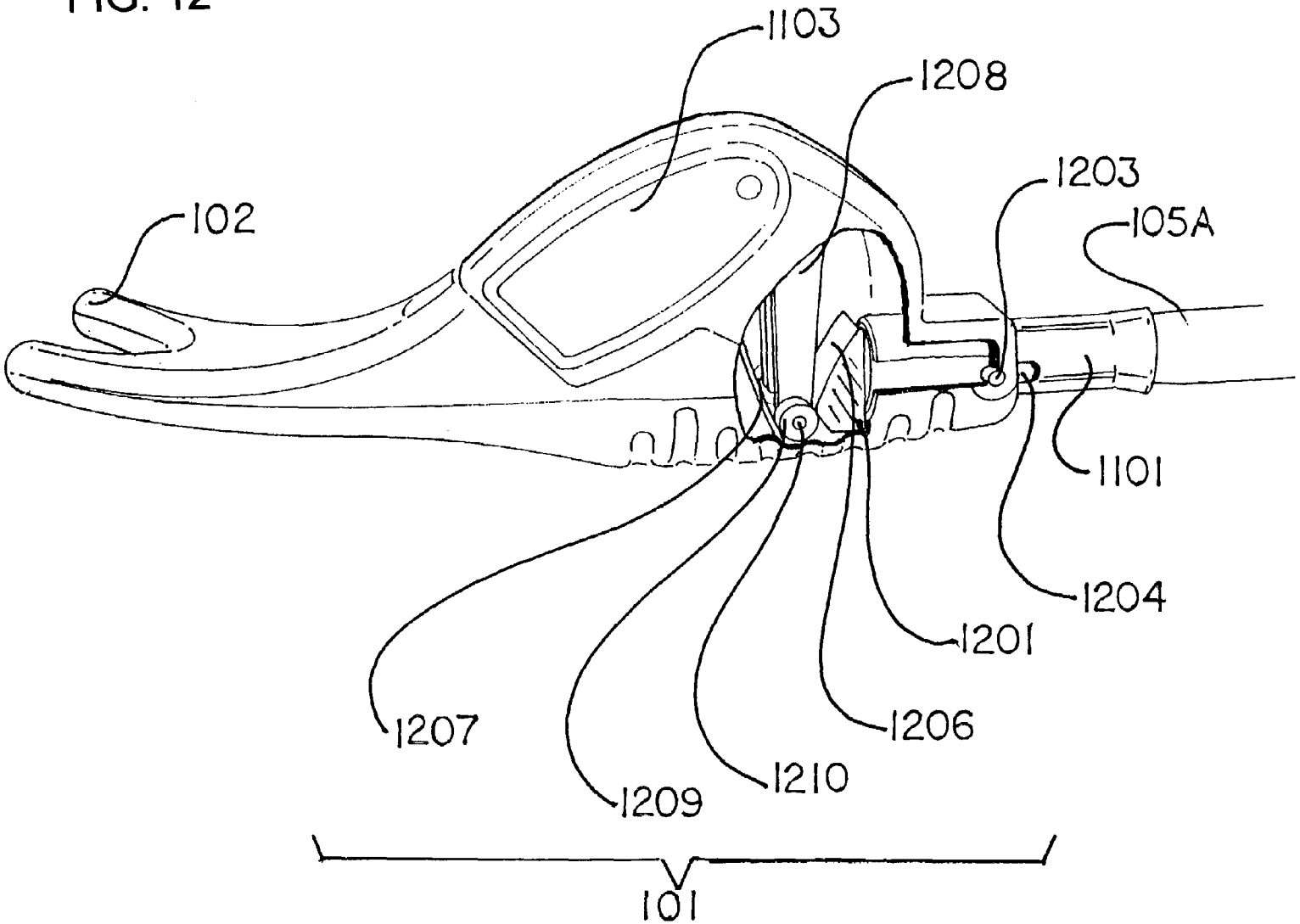
FIG. 12 is a partially cutaway view of the head assembly in the closed position.
Figure 13:
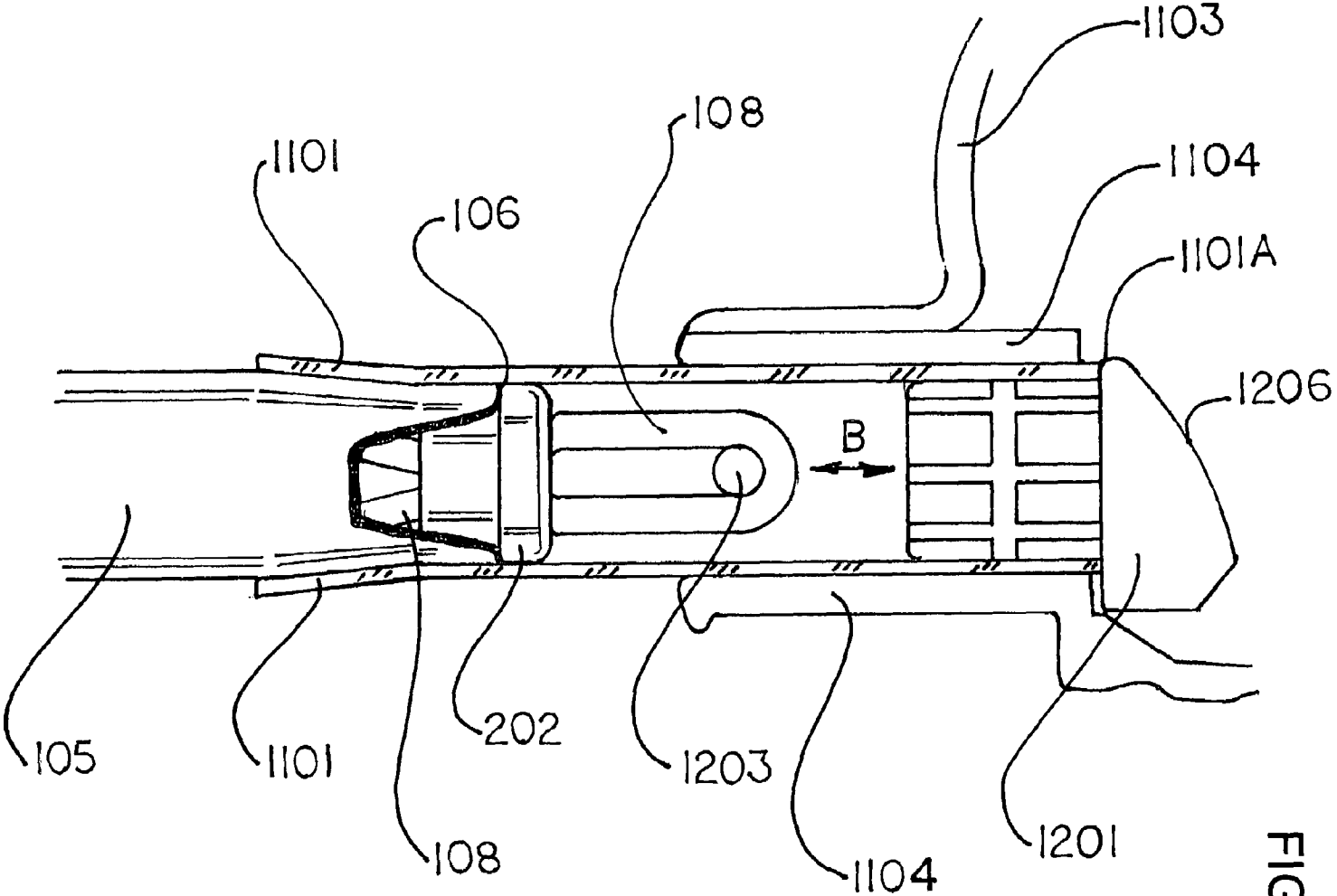
FIG. 13 is a cross section of the join between the handle and the shaft.

The handle 101 is shown in FIGS. 11, 12 and 13. The handle 101 has a body 1102 and a lever 1103. The body 1102 is hollow and has an attachment tube 1104 to attach the handle 101 to the shaft 103. Tube 1101 is slidably mounted inside attachment tube 1104, as shown in FIG. 13. The top end 106 of segment 105*a* fits into tube 1101 as shown in FIG. 13 when the shaft is unfolded.

The lever 1103 is pivotally attached to the body 1102 at pivot 1203, which extends through the tube 1101 and attachment tube 1104 and is fixed to attachment tube 1104, as shown in FIG. 11. Tube 1101 has longitudinally extending slots 1204 to allow the tube 1101 to slide backward and forward in relation to the handle 101 as shown by arrow B in FIGS. 11 and 13. Pivot 1203 also serves as the attachment anchor for the elastic cord 108 as shown in FIG. 13. This pulls the handle 101 down onto tube 1101, shortening the overall length of the door brace 1100.

The tube 1101 extends into the body 1102 of the handle 101 as shown in FIG. 11. The top end 1101*a* of tube 1101 extends though the attachment tube 1104 and has a cam 1201 attached to the top end 1101*a* as shown in FIGS. 11, 12 and 13. The cam 1201 sets in cavity 1202 in the body 1102. The pulling effect of the elastic cord 108, pulls the tube 1101 and cam 1201 up into cavity 1202, so that the curved surface 1206 of the cam rests on or near the slanted surface 1207 of the cavity 1202. These two surfaces form a psuedo-V shape when the handle 101 is open as shown in FIG. 11.

The lever 1103 has an arm 1208 extending downward. Mounted on the bottom edge of the arm 1208 is an axle 1210 with rollers 1209. The arm 1208 and rollers 1209 are positioned so that as the lever 1103 is moved downward towards a closed position, as shown by arrow A, the rollers 1209 move over the curved surface 1206 of the cam 1201 and into the V. As the rollers 1209 move into the V the width of the rollers 1209 pushes the cam 1201 and tube 1101 into attachment tube 1104, moving the handle 101 upward on tube 1101 and attached segment 105*a*, lengthening the overall length of the door brace 100, as shown in FIG. 12. In the disclosed embodiment, the length increases by about ½ inch. Other length increases are possible, simply by changing the width of the rollers 1209.

Installation

Figure 3:
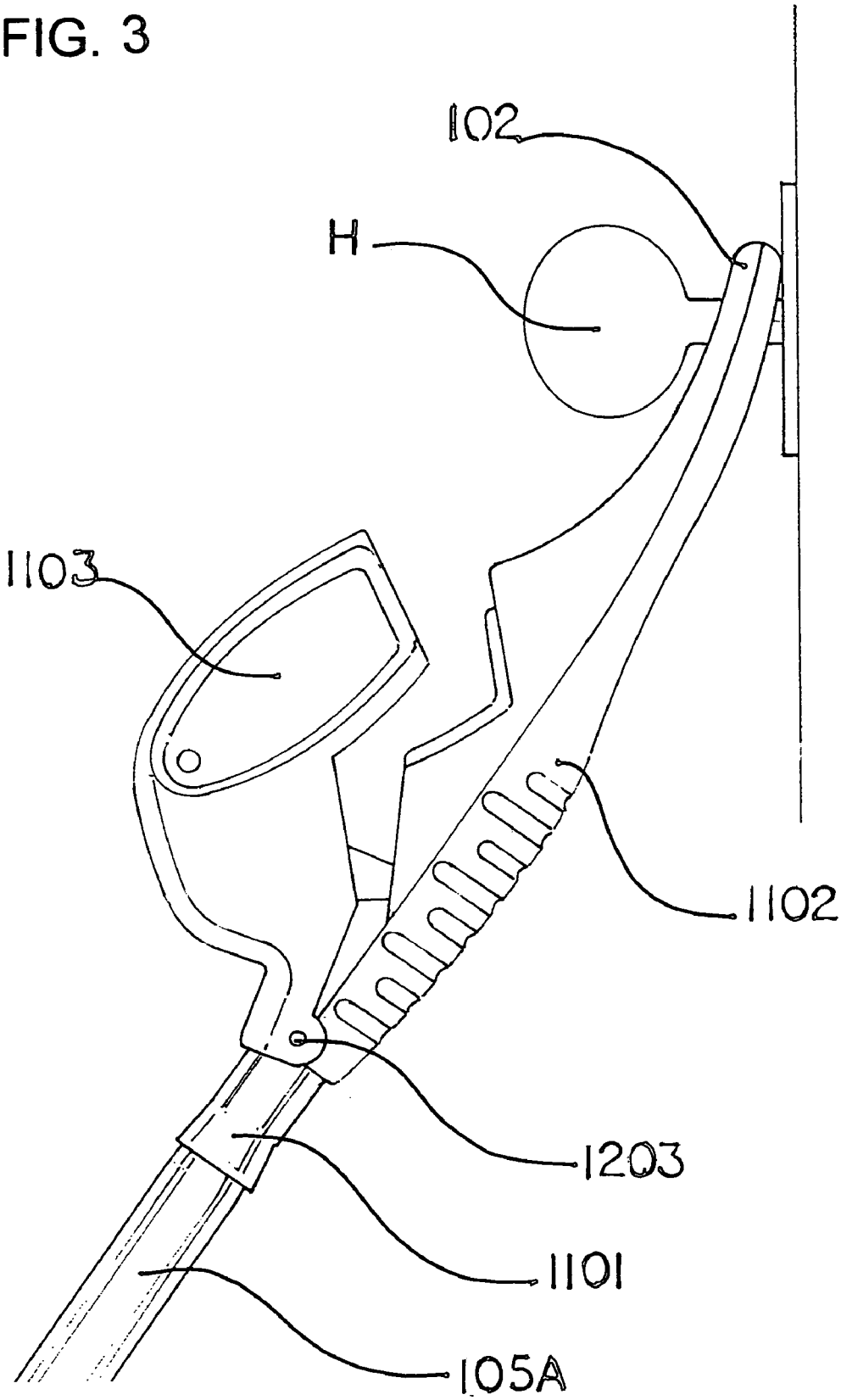
FIG. 3 is a side perspective view of the present invention mounted on a door with the handle open.

To install the door brace 100 in place on a door D, the user pulls off travel strap 201 and lets the door brace 100 unfold from folded mode, shown in FIG. 2, to the deployed mode, shown in FIG. 1. Due to the elastic cord 108, segments 105 unfold and assemble automatically. The user may occasionally need to tap one of the segments 105 into place, but no further assembly is needed. The user attaches the correct footpad 506 in the pivoting foot 104 for the type of floor surface in front of door D. The user then opens lever 1103, shortening the overall length of the door brace 100. The user then places the yoke 102 under and around the doorknob shaft S and sets the pivoting foot 104 on the floor. The door brace 100 is now in place with the lever 1103 open, as shown in FIG. 3. The user can slide the pivoting foot 104 toward the door, putting the door brace more securely in place to prevent opening of the door D. The user then closes the lever 1103, lengthening the door brace 100, and securing the door brace 100 in place in front of the door D, preventing the door from being opened.

Figure 14:
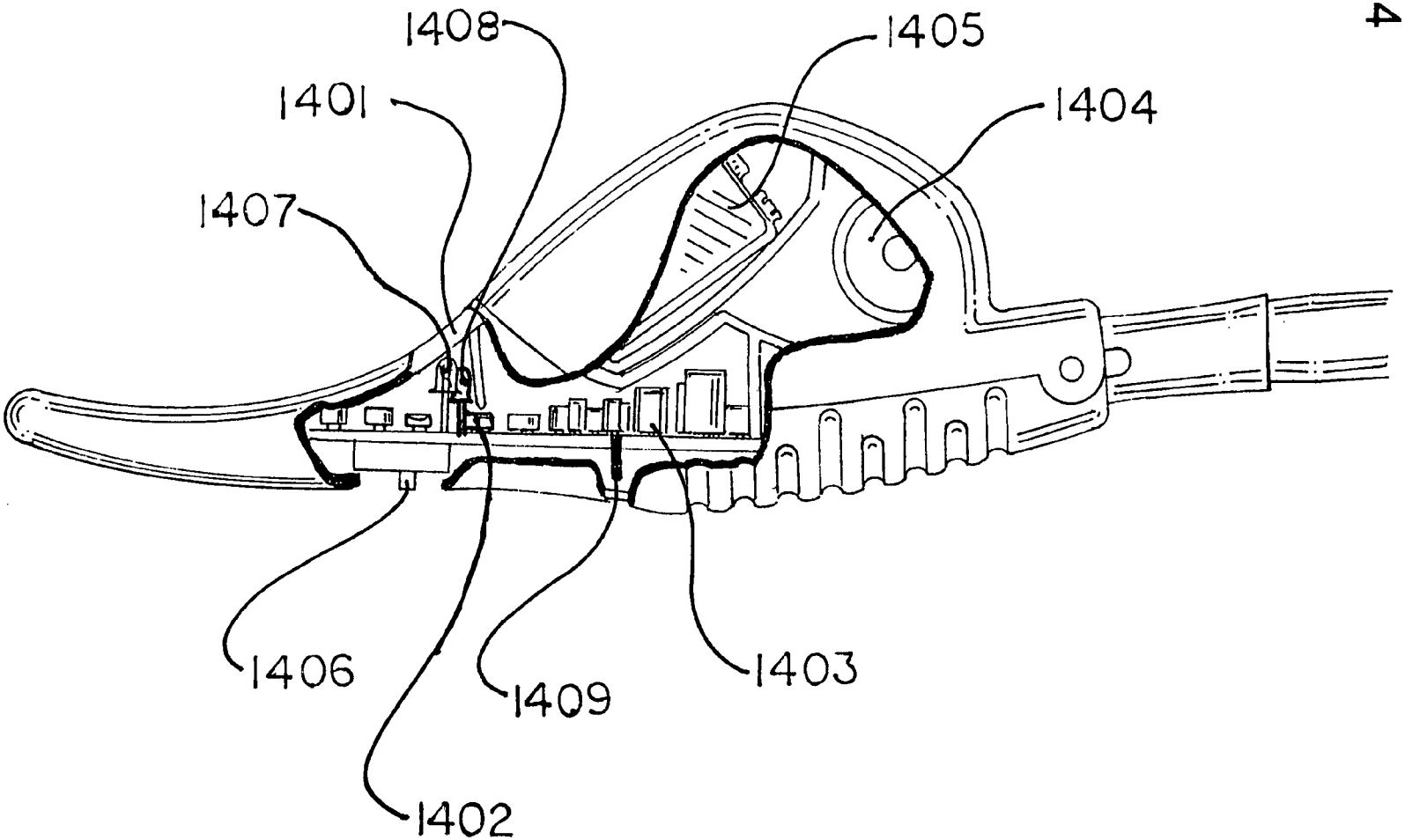
FIG. 14 is a cross sectional view of the handle assembly.

Referring next to the cross section the handle in FIG. 14 and the electrical drawings in FIGS. 15–18, the electrical alarm logic and circuitry is described.

Power Up

Closure of power switch SW1 by depressing the on/off button 1401, thereby pressing the activation switch 1402 applies power to K1 NO relay contract and Field Effect Transistor (FET) Q1. Resistor of R1 and FET Q1 form a 0.25–2 microamp current source that slowly charges capacitor C1 to the threshold voltage (2–3VDC) of transistor Q2, a N Channel MOS enhancement type, over a 30 second period. Capacitor C1 is a low leakage current type.

Until transistor Q2's gate voltage exceeds the threshold of 2–3 volts, transistor Q2 is held in a high impedance state disabling Tilt Switch SW2 from conducting current through latching relay coil K1 Set. This delays enabling the alarm giving the user time to move away from the door D. N Channel MOS Transistor Q5 across C1 is a high impedance state allowing the voltage across C1 to linearly increase.

Auto Reset

Figure 16:
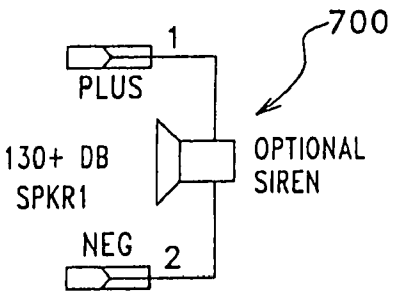
FIG. 16 is a circuit diagram of the siren and circuit.
Figure 17:
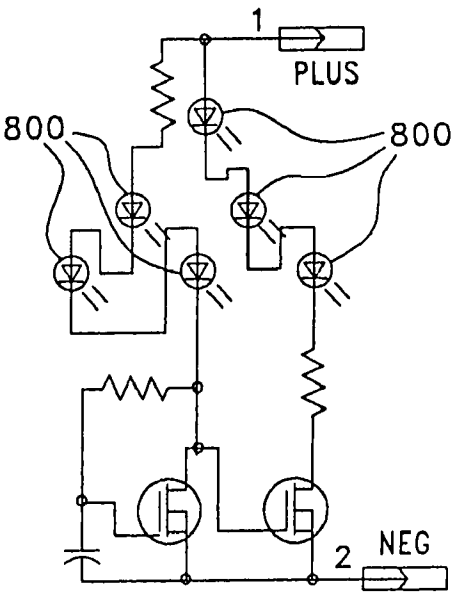
FIG. 17 is a circuit diagram of the L.E.D. array and circuit.

If latching relay K1 was in a "SET" or "ON" state at the time switch SW1 is closed power will be applied to the Siren (FIG. 16) and LED's (FIG. 17). LED 1407 is an on/off indicator light. Closure of switch SW1 quickly charges capacitor C2 through resistor R2. Resistor R2 and capacitor C2 values are selected for a time constant of 8–15 milliseconds. As capacitor C2 charges gate terminal of P Channel MOS Transistor Q3 is held near ground potential placing Q3 in a low impedance 'ON' state for a short time. Turning transistor Q3 "ON" allows current to flow into relay reset coil K1 reset switching the relay to the OFF state. Turning on Q3 to reset relay K1 also makes the gate of N Channel MOS transistor Q5 positive turning "ON" Q5 and discharging capacitor C1 resetting the 10-second delay timer. It is to be understood that varying the length of the delay timer is well known in the art.

Energizing the reset coil forces the relay to the "OFF" state, contacts K1 NO are open turning off the Siren (FIG. 16) and LED's (FIG. 17). Values of R1 and C1 are selected to give a 10 second delay for the user to move away from the door brace before C1 is fully charged.

If the relay was in the "OFF" or reset state contacts K1 NO2 would be open and no current would flow to the Siren 1404 (FIG. 16, 700) and LED's (FIG. 17, 800) saving power.

Alarm Ready or Armed

After transistor Q3 has reset the relay K1 and capacitor C1 has charged above the gate threshold voltage of transistor Q2. The electronic circuit is now ready for any would be intruder. LED 1407 is on to indicate the status of the door brace 100 to the user.

Tamper

Figure 18:
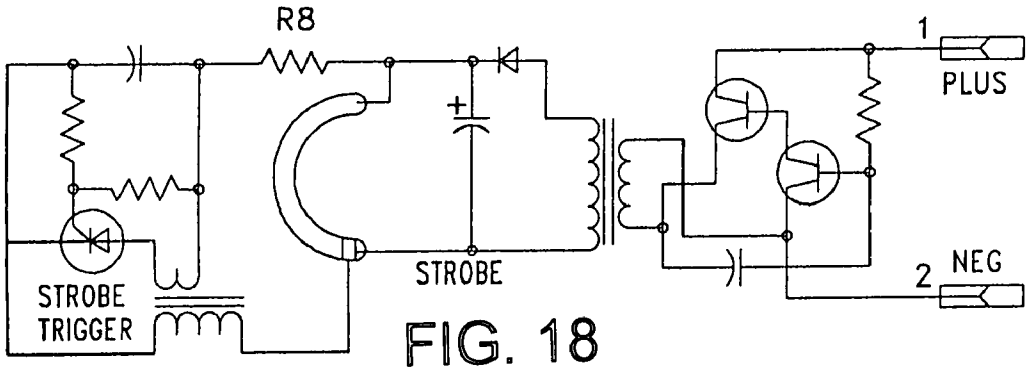
FIG. 18 is a circuit diagram of the strobe and circuit.
Figure 15:
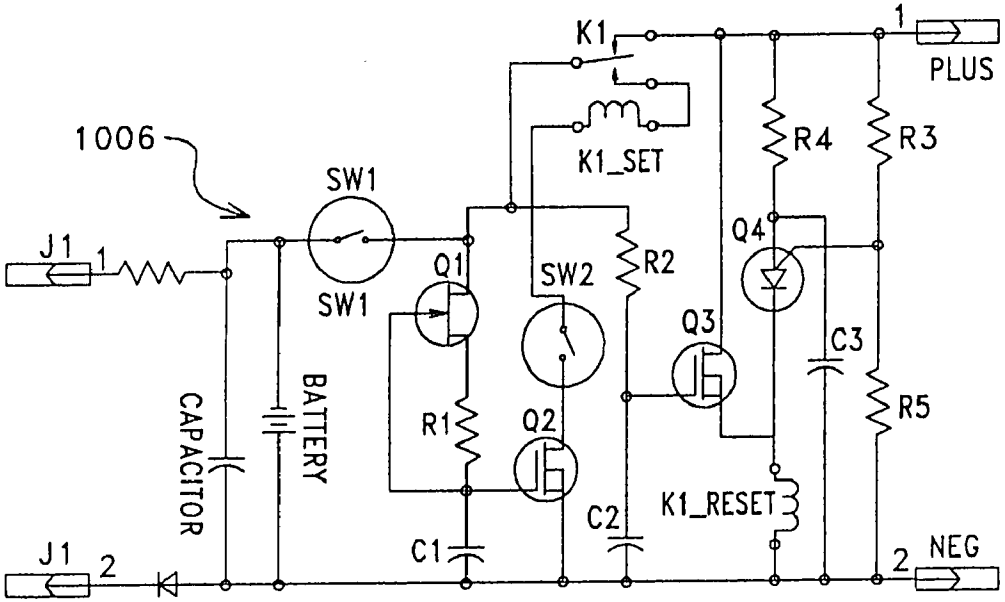
FIG. 15 is a circuit diagram of the motion detector circuit.

Closure of Tamper/Tilt switch SW2 (the motion detector 1403) is connected in series with Transistor Q2, closure allows current to flow through Relay Coil K1 Set closing relay contacts K1 No applying power to the siren 1404, and strobe circuits FIGS. 15, 16 and 18. With the closure of contacts K1 NO voltage is applied to Resistor network R4 and R5 also charging capacitor C3 through R3. Capacitor C3 is a low leakage type. R3 is selected to charge C3 over a 10 second period. Programmable unijunction transistor PUT 1 trigger when the anode voltage rises to equal the gate voltage set by R4 and R5. Discharging capacitor C3 into Q4's anode and into coil K1 resets turning "OFF" or resetting the alarm. Application of power to the reset coil K1 reset turns on transistor Q5 discharging Capacitor C1. Placing the system in the power up state. If the Tilt switch is still closed the alarm will not trip until capacitor C1 charges turning "ON" transistor Q2. This cycle will repeat until the intruder gives up or the internal power source battery 1405 or C4 is depleted.

The sensitivity of the motion detector (tilt switch) can be variable to allow for different levels of vibration detection depending on the setting the door brace 100 is used in. The sensitivity chosen will depend on the construction of the building, the environment around the building and the desires of the user. If the building the door brace is being used in transmits vibration well or is in an area with lots of vibration (near railroad tracks, etc.) then a low sensitivity to vibrations may be desired. If the user wishes to be alerted to any movement of the door/door knob, then a high sensitivity may be desired. The setting of motion sensitivity can be continuously variable, or have setting levels. In the disclosed embodiment, there are three sensitivity levels which are set by switch 1406, shown in FIG. 14.

Power

The door brace 100 may be powered by a primary cell, rechargeable battery or multi-fared capacitor C4. Charging may be accomplished with a simple resistor R6 or a more complex charger appropriate for the type of battery selected. In an alternate embodiment, the door brace 100 can have a plug-in mode as shown in FIG. 14. AC to DC adaptor plug in point or port 1409 is connected to the circuitry in a known manner.

Tampering

1) The motion sensor is set to one of the possible tamper tolerances.
2) If the motion sensor detects an amount of motion in the door and/or door handle that exceeds the chosen tamper tolerance, the warning light 1408 and audible siren 1404 will be activated for a chosen length of time. In the disclosed embodiment they will be activated for 30 seconds.
3) The warning light 1408 can be a flashing light or a constantly on light; in the disclosed embodiment the light flashes.
4) After 30 seconds the alarm system shuts off, the tamper tolerance motion sensor resets itself to an armed condition.
5) Should the intruder again move the door or door handle the steps 2, 3, and 4 will repeat.

Removal

When the user wishes to remove the door brace 100, they simple turn off the electronics, by depressing the on/off button, open the lever 1103 and pull the door brace 100 up away from the floor. The user can then pull apart the segments 105 and fold the door brace 100 in to the folded mode and secure the segments 105 in place with the travel strap 201 as shown in FIG. 2.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A door brace having a travel mode and an operational mode, said door brace comprising:

a multipart shaft having an elastomeric cord connecting the parts of the shaft;

the parts of said shaft being removably attached to each other;

the parts of the shaft being separated and folded together in the travel mode, and attached together in the operational mode;

a foot rotatably mounted on a foot end of the shaft, said foot being adapted to brace against a floor in front of a door;

said foot further comprising an exchangeable pad, said pad being selected from a group adapted to a number of different types of floors;

a handle movably attached to a handle end of the shaft;

said handle further comprising a motion detector, an audible alarm and a visual alarm, said alarms being activated when the motion detector senses a chosen level of movement;

a power source to power the motion detector and the alarms;

said handle having a yoke adapted to fit around a door handle on the door and a lever movably mounted on the handle, said lever having an open and a closed position; and wherein the lever cooperates with a cam attached to the handle end of the shaft such that when the lever is in the open position the overall length of the door brace is shortened and when the lever is in the closed position the length of the door brace is longer such that when the lever is closed in the operation position the door brace will be firmly installed against a door with the yoke around the door handle, preventing the opening of the door.

2. The door brace of claim 1 on, wherein the exchangeable pad is selected from the group consisting of a carpet pad, a pad for hard smooth floors, a pad for industrial floors and a pad for uneven surfaces.

3. A door brace means having a travel mode and an operational mode, said door brace means comprising:

a multipart shaft having an stretchable connecting means attaching the parts of the shaft together;

the parts of said shaft being removably attached to each other;

the parts of the shaft being separated and folded together in the travel mode, and attached together in the operational mode;

a foot means rotatably mounted on a foot end of the shaft, said foot means functioning to brace against a floor in front of a door;

said foot means further comprising an exchangeable pad means, said pad means being selected from a group adapted to a number of different types of floors;

a handle means movably attached to a handle end of the shaft;

said handle means further comprising a motion detector, an audible alarm and a visual alarm, said alarms being activated when the motion detector senses a chosen level of movement;

a power means to power the motion detector and the alarms;

said handle means having a yoke adapted to fit around a door handle on the door and a lever means movably mounted on the handle means, said lever means having an open and a closed position; and wherein the lever means cooperates with a cam means attached to the handle end of the shaft such that when the lever means is in the open position the overall length of the door brace is shortened and when the lever means is in the closed position the length of the door brace is longer such that when the lever is closed in the operation position the door brace will be firmly installed against a door with the yoke around the door handle, preventing the opening of the door.

* * * * *